United States Patent [19]

Funaji et al.

[11] Patent Number: 4,762,526

[45] Date of Patent: Aug. 9, 1988

[54] PROCESS FOR DEASHING COAL

[75] Inventors: Taiichi Funaji, Tsurugashima; Haruo Iso, Ibaraki; Jisaku Tanimichi, Yokohama; Kenichi Nagata, Yachiyo; Toshiaki Murata; Hideto Mitsui, both of Tokyo, all of Japan

[73] Assignees: The Tokyo Electric Power Co., Inc.; Mitsui Engineering & Shipbuilding Co., Ltd.; Mitsui & Co., Ltd., all of Tokyo, Japan

[21] Appl. No.: 900,574

[22] Filed: Aug. 26, 1986

Related U.S. Application Data

[63] Continuation-in-part of Ser. No. 786,976, Oct. 15, 1985, abandoned.

[30] Foreign Application Priority Data

Oct. 26, 1984 [JP] Japan ..... 59-223868

[51] Int. Cl.[4] ..... C10L 5/16; C10L 9/10

[52] U.S. Cl. ..... 44/627; 209/166

[58] Field of Search ..... 44/1 G, 1 R, 1 SR, 1 A, 44/24; 209/166

[56] References Cited

U.S. PATENT DOCUMENTS

| | | | |
|---|---|---|---|
| 4,018,571 | 4/1977 | Cole et al. | 44/1 R |
| 4,249,910 | 2/1981 | Masologites et al. | 44/1 A |
| 4,272,250 | 6/1981 | Burk, Jr. et al. | 44/1 SR |
| 4,455,148 | 6/1984 | Nagata et al. | 44/1 SR |

*Primary Examiner*—Carl F. Dees

*Attorney, Agent, or Firm*—Armstrong, Nikaido, Marmelstein & Kubovcik

[57] ABSTRACT

Disclosed is a process for deashing coal, which comprises the following steps (a) to (e):

(a) crushing coal to form crushed coal having a particle size distribution of 0.05 to 15 mm and an average particle size of 0.5 to 2 mm, (b) producing an aqueous slurry comprising the crushed coal, 1 to 4 wt. % of a binder based on the crushed coal, and water, (c) feeding the aqueous slurry of the crushed coal to a cylindrical agglomerator provided with disk impellers in a multistage manner and effecting collision and agglomeration among the crushed coal particles by the rotation of the impellers and effecting tumbling and agglomeration of the agglomerate to produce an aqueous slurry of spherical or spheroidal hard agglomerated coal, (d) separating the aqueous slurry of the agglomerated coal by treating with a solid-liquid separator into first agglomerated coal on the separating medium and an aqueous slurry of second agglomerated coal and ash which have passed through the separation medium, and (e) adding a frother or a frother-based flotation reagent to the aqueous slurry of the second agglomerated coal and the ash and recovering the second agglomerated coal by flotation.

9 Claims, 4 Drawing Sheets

PROCESS FOR DEASHING COAL

This application is a continuation-in-part of U.S. Ser. No. 786,976, filed Oct. 15, 1985, now abandoned.

BACKGROUND OF THE INVENTION

This invention relates to a process for deashing coal and, more particularly, to a coal deashing process comprising producing agglomerated coal from crushed coal and a binder and at the same time removing inorganic minerals (hereinafter referred to as ash) in the crushed coal, wherein the binder is used in a reduced amount, the agglomerated coal is separated by means of a screen and recovered, and fine agglomerated coal contained in an ash slurry as an undersize is recovered by flotation.

A conventional oil agglomeration process (hereinafter referred to as OA process) is a process for removing ash from steam coal (hereinafter referred to simply as coal) and recovering coal.

This OA process comprises crushing coal so that 70 to 80% of the particles can pass through a 200-mesh screen, adding about 20 wt.%, based on pure coal, of a binder such as petroleum hydrocarbon oil and water to the obtained crushed coal to form an aqueous slurry of the crushed coal, agitating the slurry to allow the crushed coal particles to tumble and agglomerate into agglomerated coal and at the same time to allow ash particles in the crushed coal to disperse into the water.

However, this OA process has an economical disadvantage because the binder is used in a large amount.

Therefore, in order to reduce the use amount of a binder, a process in which the particle size of crushed coal was reduced to 6 mm or smaller was practiced. According to this process, the amount of a binder added can be reduced because the specific surface area of the crushed coal is increased.

However, the binder must be added in an amount of 8 to 20 wt.% also in this process, so that it has the following drawbacks:

A: When the agglomerated coal is fed as a fuel into a boiler fired with pulverized coal, it is necessary to pulverize the agglomerated coal to obtain a particle size distribution, for example, such that 70 to 80% of the pulverized coal can pass through a 200-mesh screen.

However, since a large amount of a binder is still contained in the agglomerated coal as mentioned above, the coefficient of friction of the agglomerated coal is decreased, which makes the pulverization of the coal difficult, so that the cost of power required for the pulverization is significantly increased.

FIG. 1 shows the relationship between the binder content (wt.%) and the power requirement (kWh/ton), wherein the curves A and B refer to two kinds of coal.

FIG. 1 clearly shows that the power requirement increases as the binder content is increased.

B: The pulverized coal obtained by pulverizing the agglomerated coal is piped to a boiler. However, since the agglomerated coal contains a large amount of a binder, the pulverized coal adheres to the inside wall of a transportation pipe, so that it can not be fed quantitatively to the boiler.

As a result, the combustion in the boiler becomes unstable, the amount of fine pulverized coal unburnt increases, and the combustion efficiency decreases. This makes it impossible to stably operate the boiler.

Table 1 shows the relationship between the binder content in the agglomerated coal and the amount of the pulverized coal adhering to the inside wall of a transportation pipe for the pulverized coal. FIG. 2 shows the relationship between the binder content in the agglomerated coal and the oxygen concentration in combustion exhaust gas.

Table 1 clearly shows that, when the binder content in the agglomerated coal is increased, the amount of the pulverized coal adhering to the inside wall of the transportation pipe is markedly increased.

In FIG. 2, the curve C shows the oxygen concentration in combustion exhaust gas produced when the pulverized coal is in a state of stable combustion and the curve D shows a case where the pulverized coal is in a state of unstable combustion due to the adhesion of pulverized coal to the inside wall of the transportation pipe.

It is clear that the curve D is markedly fluctuating as compared with the curve C.

TABLE 1

| Binder content in agglomerated coal (wt. %) | Amount of pulverized coal adhering to the inside wall of a transportation pipe ($g/m^2$) |
|---|---|
| 6 | 1.9 to 7.5 |
| 8 | 52.5 |

C: Because the agglomerated coal still contains a large amount of a binder, it forms lumps by compression when piled up in a coal yard, a silo or a hold. This makes its handling in subsequent steps difficult.

D: When an aqueous slurry of the crushed coal is agitated in the presence of a large amount of a binder, the agglomerated coal produced has a uniform diameter or a large particle size. When the agglomerated coal is piped, the critical velocity in a pipe is so large that the deposition of the agglomerated coal occurs in the pipe.

In order to prevent this deposition, it is necessary to increase the flow velocity of the agglomerated coal through the pipe, which leads to an increased power for transportation.

E: The ratio of the cost of a binder used to the total manufacturing cost of the agglomerated coal amounts to as high as 30 to 40%, so that the OA process is very questionable from the viewpoint of economy.

F: The particle size of the agglomerated particles is smaller because of a smaller amount of a binder as compared with that in the OA process, so that the percentage recovery of agglomerated coal is as low as about 70% when recovered by screening.

SUMMARY OF THE INVENTION

It is therefore a first object of this invention to provide a process for deashing coal, wherein the amount of a binder used in the production of agglomerated coal from crushed coal can be reduced markedly.

It is a second object of this invention to provide a process for deashing coal, wherein the percentage recovery of combustibles and the percentage deashing can be improved.

DETAILED DESCRIPTION OF THE INVENTION

Figure 1:
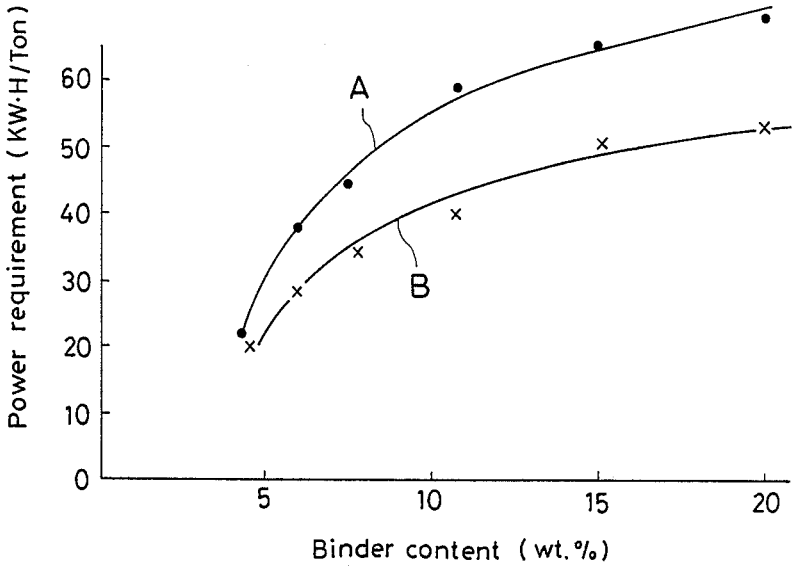
FIG. 1 is a diagram showing the relationship between the amount of power required for pulverizing agglomerated coal obtained by the conventional OA process and its binder content.
Figure 2:
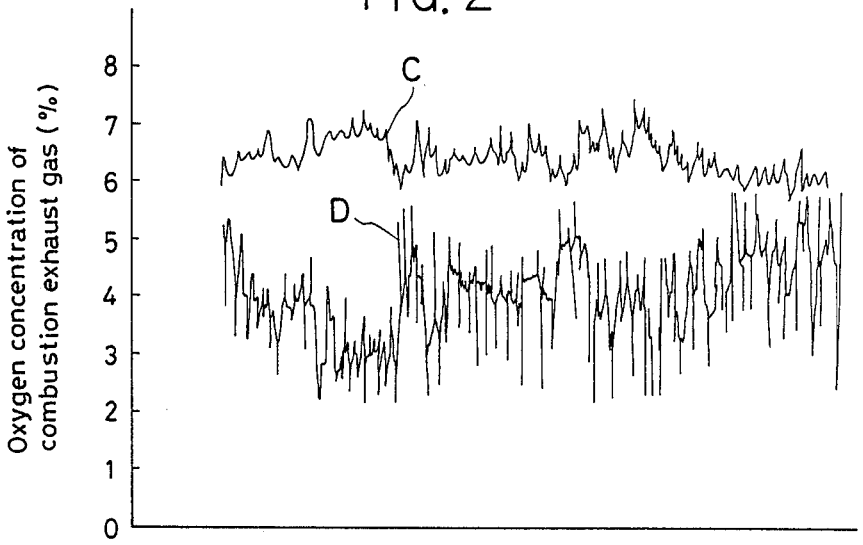
FIG. 2 is a diagram showing a comparison between a variation in the oxygen concentration in combustion exhaust gas from pulverized coal obtained by pulverizing the agglomerated coal obtained by the OA process and a variation in the oxygen concentration of combustion exhaust gas in a state of stable combustion.

This invention will now be described in detail with reference to a process flow chart of FIG. 3.

First, coal 1 is crushed in a crusher 2 into crushed coal 3. The crushed coal 3 has a particle size distribution of, usually, 0.05 to 15 mm, preferably, 0.1 to 6 mm and an average particle size of, usually, 1.0 to 2.0 mm, preferably, 1.5 to 2.0 mm, though they vary with the kind of coal used. When the particle size of the crushed coal 3 is above 15 mm, the extent of separation of coal from ash in a step of crushing is decreased and the deashing effect is decreased undesirably.

Any kind of coal may be used in this invention, and examples of coal include bituminous coal, subbituminous coal, brown coal, and lignite. The crusher 2 is not particularly limited but may be a commonly used dry or wet type, so far as the crushed coal 3 can satisfy the above requirements with regard to the particle size. The crushed coal 3 is fed to a binder addition tank 4, where it is mixed with a binder 5 added. The amount of the binder is 1 to 4 wt.% based on the crushed coal.

Figure 4:
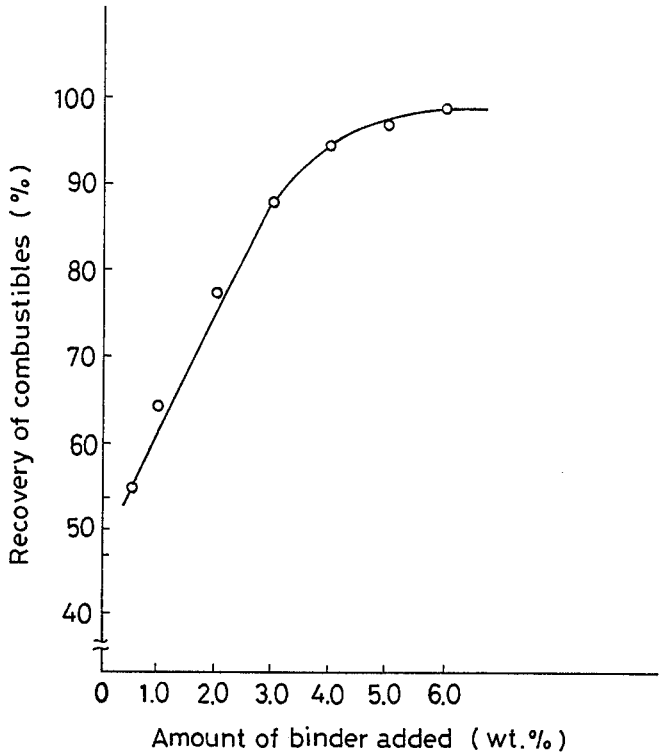
FIG. 4 is a diagram showing the relationship between the amount of a binder added in this invention and a percentage recovery of coal.

When the amount of the binder is above 4 wt.%, the drawbacks mentioned in A to C result, while when it is below 1 wt.%, the formation of agglomerated coal becomes insufficient and the percentage coal recovery is decreased as FIG. 4 shows. A hydrocarbon oil is used usually as the binder 5, and examples include petroleum-derived hydrocarbon oils such as crude oil, heavy fuel oil and gas oil, coal tar, pitch, hydrogenated coal liquid oil, and vegetable oils such as soybean oil and cotton seed oil. Petroleum-derived hydrocarbon oils are preferably used.

In a slurry tank 7, water is added to the crushed coal 6 containing the binder, and the resulting mixture is stirred to form an aqueous slurry 9 of the crushed coal 3 containing the binder 5. Although the amount of the water added is not particularly limited, it is selected preferably so that the crushed coal concentration in the aqueous slurry of the crushed coal may fall within the range of from 20 to 40 wt.%, because of an easiness in producing agglomerated coal, an easiness in removing ash particles from the coal in the production of the agglomerated coal, and the like, as hereinafter mentioned.

Figure 3:
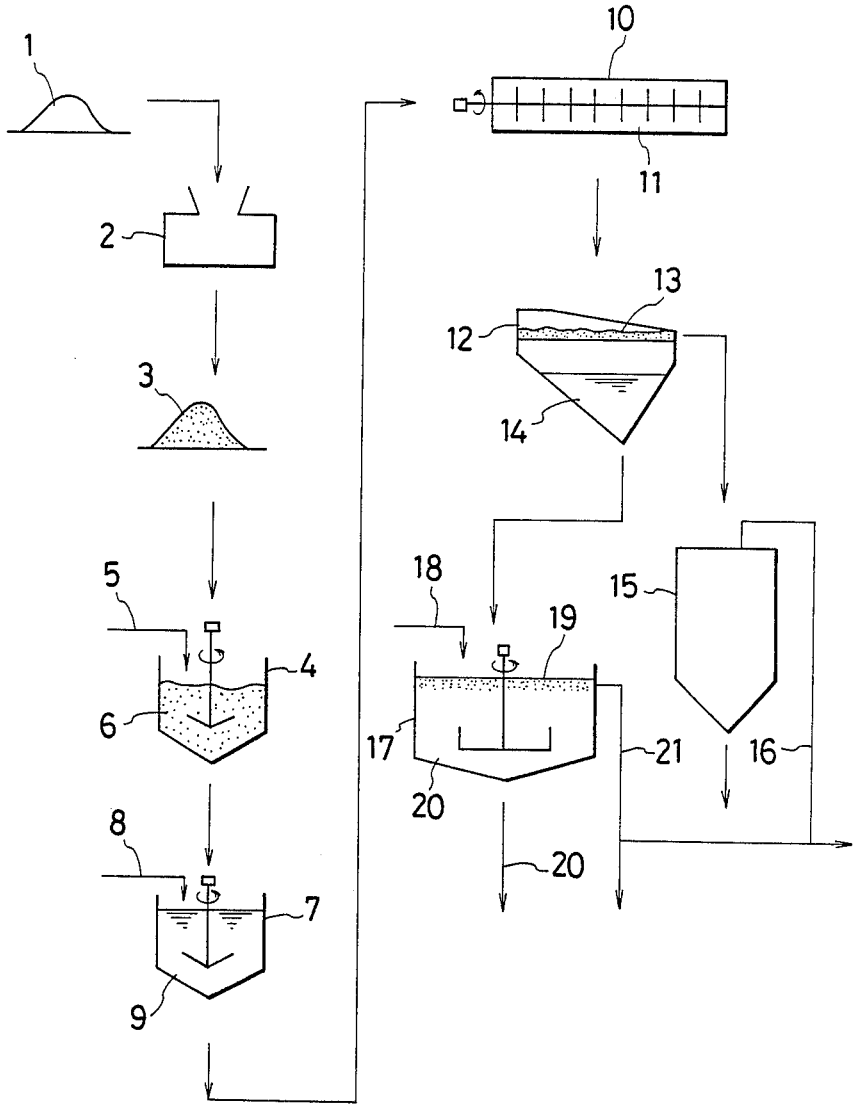
FIG. 3 is a flow chart showing the process of this invention.

Although FIG. 3 shows a case where water 8 is added after the binder 5 has been added, this invention is not limited thereto. It is also possible that water 8 is added to the crushed coal 3 and then the binder 5 is added, or that the binder 5 and the water 8 are simultaneously added to the crushed coal 3. Further, it is preferable that a surfactant, for example, polypropylene glycol monoethyl ether is added to an aqueous slurry 9 of the crushed coal. The surfactant may be added to the crushed coal at any step before the step of forming the aqueous slurry 9 of the crushed coal and it may be added together with, for example, a binder.

The aqueous slurry 9 of the crushed coal containing the added binder is sent to an agglomerator 10 and agitated. This agitation effects collision, coagulation and tumbling of the crushed coal particles in the aqueous slurry in the presence of the binder to form agglomerated coal. This agglomerated coal in the form of an aqueous slurry 11 is discharged from the agglomerator 10. The aqueous slurry 11 of the agglomerated coal discharged from the agglomerator 10 is fed to a solid-liquid separator such as a screen 12. The screen 12 is, for example, one having an opening of 0.5 mm and therefore first agglomerated coal 13 having a particle size of over 0.5 mm is separated on the screen, while an aqueous slurry 14 containing second agglomerated coal having a particle size of below 0.5 mm and passing through the screen 12 and ash is obtained under the screen.

Figure 6:
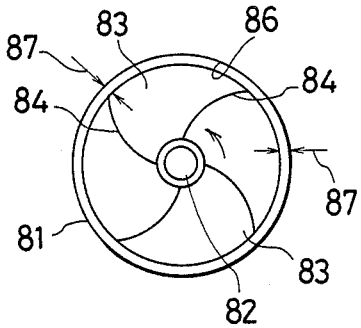
FIG. 6 is its schematic transverse sectional view.
Figure 5:
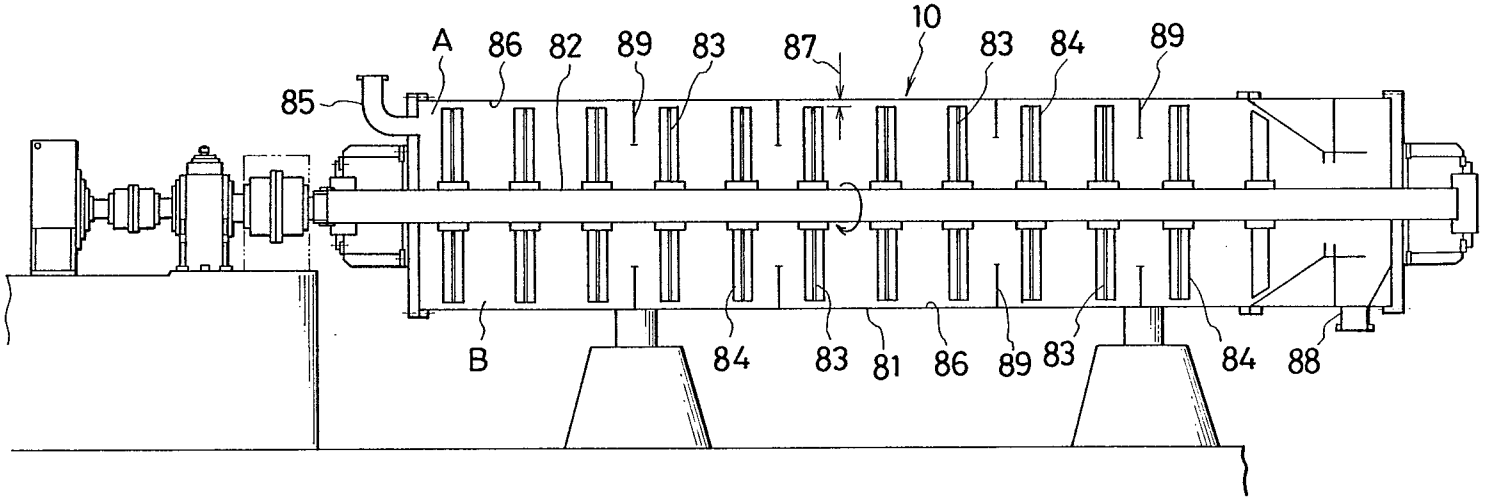
FIG. 5 is a schematic side view of an agglomerator.

In this invention, a cylindrical agglomerator 10 as shown in FIGS. 5 and 6 is used. This agglomerator 10 consists of a cylindrical body 81 and disk impellers 83 provided in a multistage manner on a rotary shaft 82 of the body 81. Preferably, each impeller 83 is provided with a turbine blade 84 in order to enhance the efficiency of tumbling and agglomeration of crushed coal. This agglomerator 10 may be of a horizontal or vertical type but the latter is preferably used. Further, a baffle 89 is provided between adjacent impellers to prevent short-cutting of unagglomerated crushed coal.

The peripheral speed in rotation of disk impeller 83 of this cylindrical agglomerator 10 is usually 10 to 15 m/sec, preferably, 12 to 14 m/sec.

The course of the formation of agglomerated coal in this agglomerator 10 can be described in more detail as follows.

Namely, in FIG. 5, an aqueous slurry 11 of the crushed coal containing a binder is fed through a feed pipe 85 to the first-stage space A of the agglomerator 10. This aqueous slurry 11 is violently agitated by the rotation of the impellers 83. As a result, the crushed coal particles in the aqueous slurry 11 collide with each other in the presence of the binder and agglomerate to form flock agglomerate. This agglomerate is pressed forcibly against the inside wall 86 of the body of the agglomerator 10 by the action of the turbine blades 84 provided on the impellers 33. While being pushed against the inside wall 86, this agglomerate is tumbled and dewatered to form partially agglomerated coal. On the other hand, as FIGS. 5 and 6 show, there is a narrow (2 to 10 mm, preferably, 2 to 5 mm) clearance 87 between each impeller 83 and the inside wall of the body 81 of the agglomerator. The aqueous slurry of the crushed coal containing the agglomerated coal formed as above in the first-stage space A enters the second-stage space B through this clearance 87, and unagglomerated crushed coal is agglomerated in the same manner as above. In this manner, while the aqueous slurry of the crushed coal containing the binder is passing through the space of each stage of the agglomerator, the crushed coal is agglomerated, and finally hard spherical to spheroidal agglomerated coal in the form of an aqueous slurry is discharged from a discharge pipe 88. The formed first agglomerated coal has a particle size of, usually, 500 to 5000 μm, preferably, 500 to 2000 μm and the concentration of the agglomerated coal in the aqueous slurry of the agglomerated coal is 20 to 30 wt.%. In addition, this agglomerated coal has excellent water repellency and good separability from water because its surface is coated with a binder. Further, when the aqueous slurry of the agglomerated coal is filtered through a solid-liquid separator, for example, a 100-mesh (149 μm) screen, the first agglomerated coal can be easily separated because the surface of the agglomerated coal is water-repellent as mentioned above. As a result, the adhering water of the first agglomerated coal can be reduced to 5% or below.

The first agglomerated coal 13 obtained in this way can be used as such, as a fuel, or may be used after it is converted into a first product agglomerated coal 16 by feeding it to a separator 15 as shown in FIG. 3, for example, a jig or a heavy-media cyclone and removing contained refuse by a gravity concentration method. On the other hand, the aqueous slurry 14 (FIG. 3) containing second agglomerated coal separated as an undersize and ash is sent to a flotation machine 17.

In the flotation machine 17, water is usually added further to adjust the concentration of the second agglomerated coal. This addition of water is made for the purpose of facilitating the recovery of the second agglomerated coal, which will be described below, so that it is not always necessary. The adjustment of the concentration of the second agglomerated coal may be performed in the flotation machine 17, or it is also possible that the concentration is adjusted in a concentration adjustment tank separately provided (not shown), and the aqueous slurry of the second agglomerated coal having an adjusted concentration is fed to the flotation machine 17.

In the flotation machine 17, a frother or a frother-based flotation reagent 18 is added. A frother has a function of frothing the aqueous slurry 14 containing the second agglomerated coal and ash, and includes, for example, pine oil, terpineol oil, polyoxypropylene alkyl ether, and a higher alcohol such as methylisopropylcarbinol.

The frother-based flotation reagent means a mixture of a frother as described above and a collector, for example, kerosene or a mixture of a frother and a froth stabilizer such as an alkylolamide.

The collector has a function of agglomerating the second agglomerated coal, and the froth stabilizer has a function of stabilizing froth formed by the action of a frother. The choice between the use of a frother and that of a frother-based flotation reagent is made suitably according to coal quality, ash content and the particle size of the second agglomerated coal.

Usually, both of the frother and the frother-based flotation reagent may be commercially available products.

The amount of the frother or the frother-based flotation reagent in this invention is 20 to 200 ppm, based on the weight of the second agglomerated coal contained in the aqueous ash slurry 14. The amount of a collector or a froth stabilizer in the frother-based flotation reagent is 20 to 30 wt.%, based on the frother. When the amount of the frother or the frother-based flotation reagent is below 20 ppm, frothing is insufficient and the flotation and the recovery of the second agglomerated coal are difficult. When this amount is above 200 ppm, the recovery of the second agglomerated coal increases, so that the addition in such an amount is economically undesirable. The second agglomerated coal is oleophilic because of its surface coated with a binder and has a particle size which is suitable for flotation (about 208 μm).

On the other hand, the ash is more hydrophilic than the second agglomerated coal. Therefore, when the second agglomerated coal is recovered by flotation in the flotation machine 17, the sharpness of separation is extremely good.

When the extent of the sharpness of separation in flotation is represented by an ash content in tailing, the ash content in this invention reaches 80% or higher. Usually, even caking coal, which has good flotation separability, has an ash content in tailing as high as about 65 to 75% and noncaking coal has an ash content of 30 to 40%, which is not satisfactory in economy.

On the contrary, in this invention, the ash content in tailing is 80% or higher independently of the kind of coal used, which supports excellent separability of agglomerated coal in flotation.

Namely, the second agglomerated coal 19 floats by the action of the froth formed from the frother and thus the second agglomerated coal is separated from ash. The floating second agglomerated coal 19 is separated from the ash slurry 20 by a method similar to that employed in a usual flotation process. The separated second agglomerated coal 19 is recovered as a second product agglomerated coal 21, which, alone or as a mixture with the first product agglomerated coal 16, is used as a fuel for a boiler, a power plant, etc.

Figure 7:
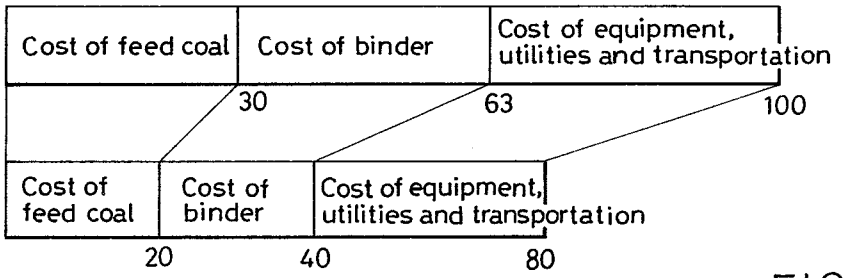
FIG. 7 is a diagram showing an example of the cost analysis of coal recovery by the conventional OA process and the process of this invention.

According to this invention, the following effects can be obtained:

(a) Because the amount of a binder is extremely small as compared with that in the conventional OA process, the coefficient of friction is higher, so that the pulverizability is good, and the cost of power for pulverization can be reduced in pulverization for obtaining a boiler fuel. FIG. 7 shows an example of the cost analysis of coal deashing by the conventional OA process and the process of this invention.

(b) By reducing the amount of a binder, it is possible to prevent the adhesion of pulverized coal to the inside wall of a transportation pipe when pulverized coal obtained by pulverizing the agglomerated coal is piped. Therefore, it is possible to keep the combustion in a burner in a stable state.

(c) By reducing the amount of a binder, it is possible to prevent the formation of lumps when the agglomerated coal is piped or piled up.

(d) According to the invention of this application, it is possible to reduce the amount of a binder used in the production of agglomerated coal and to enhance the percentage recovery of combustibles and the percentage removal of ash.

(e) When the first and second agglomerated coals obtained by this invention are mixed together, the distribution of the particle size is widened, and the particle size becomes nonuniform. Therefore, when the agglomerated coal is piped, the critical velocity of the agglomerated coal in the transportation pipe can be decreased as compared with that of the agglomerated coal obtained by the conventional OA process. Therefore, it is possible to prevent the deposition of the agglomerated coal in the transportation pipe and to reduce the required power for transportation.

(f) By reducing the amount of a binder, it is possible to reduce the manufacturing cost of agglomerated coal by 20 to 30% as compared with that in the OA process. FIG. 11 shows a comparison of the manufacturing costs.

(g) Besides, since the second agglomerated coal can be recovered as a product coal from a slurry of an undersize in this invention, the percentage recovery of combustibles can be enhanced and the cost of feed coal can be reduced.

(h) Therefore, by reducing the amount of a binder and by recovering coal passing a screen by flotation, the manufacturing cost of the agglomerated coal can be reduced by 20 to 30% as compared with that in the conventional OA process.

This invention will now be described with reference to examples.

EXAMPLE

Coal was deashed according to the process shown in FIG. 3. Namely, coal was crushed into particles having a particle size under 13 mm, and 3.5 wt.% of a binder and water were added to the crushed coal to produce an aqueous slurry of the crushed coal.

This aqueous slurry was fed to a horizontal cylindrical agglomerator to produce an aqueous slurry of agglomerated coal. This aqueous slurry was classified through a 0.5 mm screen to obtain first agglomerated coal on the screen and an ash slurry containing second agglomerated coal under the screen. The first agglomerated coal is sorted using a heavy-media cyclone to obtain agglomerated coal as a product. On the other hand, a frother was added to the ash slurry containing the second agglomerated coal as an undersize to recover the second agglomerated coal by flotation. Table 2 shows the properties and percentage recoveries of combustibles of the agglomerated coal product.

TABLE 2

| | Feed coal | Agglomerated coal product |
|---|---|---|
| Ash content (wt. %, dry basis) | 29 | 9.3 |
| Pure coal (wt. %, dry basis) | 71 | 86.1 |
| Binder | | 4.6 |
| Calorific value (kcal/kg, dry basis) | | 7400 |
| Percentage recovery of combustibles (wt. %) | | 93 |

What is claimed is:

1. A process for deashing coal, comprising the following steps:

(a) crushing coal to form crushed coal having a particle size distribution of 0.05 to 15 mm and an average particle size of 0.5 to 2 mm, (b) producing an aqueous slurry comprising said crushed coal, 1 to 4 wt.% of a binder based on said crushed coal, and water, (c) feeding the resulting aqueous slurry of the crushed coal to a horizontal cylindrical agglomerator provided with disk impellers in a multistage manner and effecting collision and agglomeration among said crushed coal particles by the rotation of said impellers rotating at a peripheral speed within the range of 10–15 μm/sec, and effecting tumbling and agglomeration of the agglomerate to produce an aqueous slurry of spherical or spheroidal hard agglomerated coal having a particle size in the range of 500 to 5000 μm, (d) separating said aqueous slurry of the agglomerated coal by treating it with a solid-liquid separator into first agglomerated coal containing adhering water of 5% or less on the separating medium and an aqueous slurry of second agglomerated coal and of ash which have passed through the separation medium, and (e) adding a frother or a frother-based flotation reagent to said aqueous slurry of the second agglomerated coal and the ash and recovering said second agglomerated coal by flotation.

2. A process for deashing coal according to claim 1, wherein the binder is an oil selected from the group consisting of petroleum-derived oils such as crude oil, heavy fuel oil or gas oil; hydrocarbon oils such as coal tar, pitch and hydrogenated coal liquid oil; and vegetable oils such as soybean oil and cotton seed oil.

3. A process for deashing coal according to claim 1, wherein a surfactant is added to the aqueous slurry of the agglomerated coal.

4. A process for deashing coal according to claim 1, wherein the separating medium is a screen.

5. A process for deashing coal according to claim 1, wherein the first agglomerated coal is deashed by a gravity separation method.

6. A process for deashing coal according to claim 1, wherein the frother is selected from the group consisting of pine oil, terpineol oil, polyoxypropylene alkyl ethers and higher alcohols.

7. A process for deashing coal according to claim 1, wherein the frother-based flotation reagent is a mixture of a frother and a collector or a mixture of a frother and a froth stabilizer.

8. A process for deashing coal according to claim 1, wherein the frother or the frother-based flotation reagent is added in an amount of 20 to 200 ppm based on the second agglomerated coal.

9. A process for deashing coal according to claim 8, wherein the collector or the froth stabilizer is added in an amount of 20 to 30 wt.% based on the frother.

* * * * *